US008178142B2

(12) United States Patent
Greiner et al.

(10) Patent No.: US 8,178,142 B2
(45) Date of Patent: May 15, 2012

(54) METHOD FOR CONDUCTING A TREATMENT PROGRAM OF A FOOD PREPARATION APPLIANCE WITH CONSIDERATION OF AROMA PROFILES

(75) Inventors: Michael Greiner, Landsberg (DE); Oliver Merker, Buchloe (DE); Reinhard Nielsen, Landsberg am Lech (DE); Stefan Rusche, Lamerdingen (DE); Thomas Schreiner, Kaufering (DE); Manfred Breunig, Schongau (DE)

(73) Assignee: Rational AG, Landsberg/Lech (DE)

( * ) Notice: Subject to any disclaimer, the term of this patent is extended or adjusted under 35 U.S.C. 154(b) by 1007 days.

(21) Appl. No.: 12/027,727

(22) Filed: Feb. 7, 2008

(65) Prior Publication Data

US 2008/0193614 A1 Aug. 14, 2008

(30) Foreign Application Priority Data

Feb. 8, 2007 (EP) ..... 07002699

(51) Int. Cl.
*A01K 43/00* (2006.01)

(52) U.S. Cl. ..... 426/233; 426/523; 134/18; 73/23.2; 219/707

(58) Field of Classification Search ..... 426/231, 426/233, 520, 531, 523; 134/18; 73/23.2; 219/707
See application file for complete search history.

(56) References Cited

U.S. PATENT DOCUMENTS

| | | | | |
|---|---|---|---|---|
| 4,968,516 | A * | 11/1990 | Thompson | 426/233 |
| 5,723,846 | A * | 3/1998 | Koether et al. | 219/497 |
| 5,783,154 | A | 7/1998 | Althainz et al. | |
| 6,410,066 | B1 * | 6/2002 | Weng | 426/231 |
| 6,753,027 | B1 | 6/2004 | Greiner et al. | |
| 2003/0139843 | A1 * | 7/2003 | Hu et al. | 700/211 |
| 2007/0098857 | A1 | 5/2007 | Kohlstrung | |

FOREIGN PATENT DOCUMENTS

| | | |
|---|---|---|
| DE | 44 23 289 | 11/1995 |
| DE | 199 45 021 | 4/2001 |
| DE | 103 40 146 | 3/2005 |
| DE | 10 2004 062 737 | 7/2006 |
| DE | 10 2005 011 304 | 9/2006 |
| EP | 1 666 798 | 6/2006 |
| EP | 1 685 781 | 8/2006 |
| WO | WO-2004/109246 | 12/2004 |
| WO | WO-2006/069563 | 7/2006 |

OTHER PUBLICATIONS

European Search Report for Application No. EP 07 00 2699, dated Aug. 28, 2007.

* cited by examiner

*Primary Examiner* — Drew Becker
*Assistant Examiner* — Preston Smith
(74) *Attorney, Agent, or Firm* — Marshall, Gerstein & Borun LLP

(57) ABSTRACT

A method for conducting a treatment program in a preparation chamber of a food preparation appliance comprises: (a) determining at least one first value of the preparation chamber atmosphere and/or of the atmosphere surrounding the food preparation appliance before selection and/or beginning of the treatment program, (b) storing the first value, (c) determining at least one second value of the preparation chamber atmosphere and/or of the atmosphere surrounding the food preparation appliance after loading the cooking product into the preparation chamber or after introduction of a lime removal and/or cleaning agent into the preparation chamber and/or after beginning of the treatment program, (d) determining at least one third value from the first and second value, (e) comparing the third value with the stored values, and (f) conducting the treatment program as a function of the result of the comparison of the third value with stored values.

45 Claims, 1 Drawing Sheet

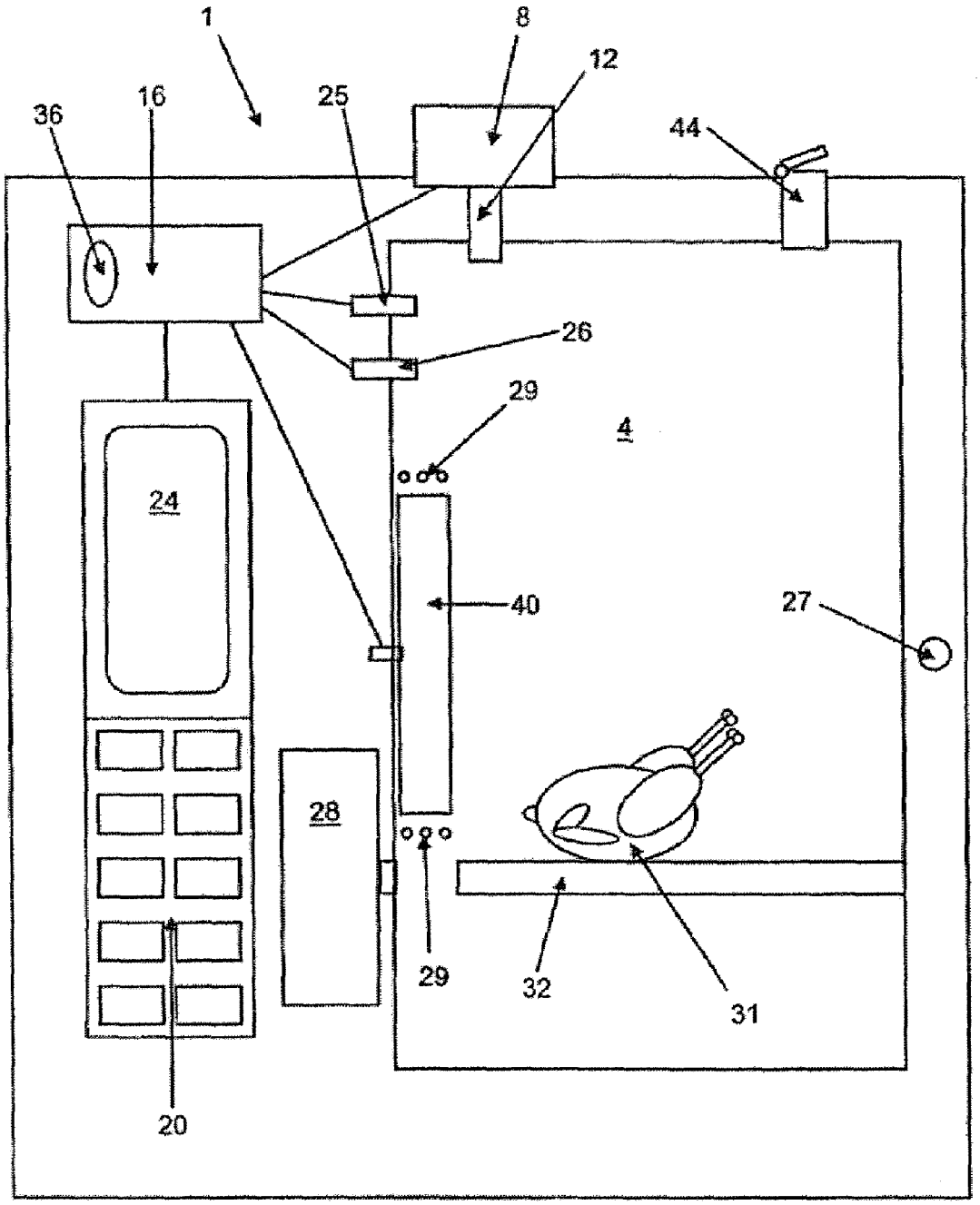
Figure

METHOD FOR CONDUCTING A TREATMENT PROGRAM OF A FOOD PREPARATION APPLIANCE WITH CONSIDERATION OF AROMA PROFILES

RELATED APPLICATIONS

The priority benefit of European Patent Application No. 07 002 699.2, filed Feb. 8, 2007, is hereby claimed, and the entire contents thereof are incorporated herein by reference.

BACKGROUND

1. Field of the Invention

The present invention concerns a method for conducting a treatment program in a preparation chamber of a food preparation appliance, in which the preparation chamber atmosphere is detected by at least one sensor unit and the treatment program is conducted as a function of the detected values and of values stored in a memory unit.

2. Related Technology

The conducting of a treatment program, especially a cooking program in a food preparation appliance plays an increasingly important role, especially in the case of food preparation appliances for large kitchens and canteens. So far, above all, humidity and temperature sensors were used in food preparation appliances. These sensors serve for the determination of conditions in a preparation chamber, but conclusions regarding the state of a cooking product placed in the preparation chamber remain limited.

More accurate information about the state of the cooking product can be obtained if one or more temperature sensors are introduced into the cooking product itself. For example, a food preparation appliance with a cooking process sensor to be introduced into a cooking product is known from DE 199 45 021 A1, in which a treatment program is conducted based on the temperatures measured within the cooking product by the cooking process sensor. Patent WO 2004/109246 A1 discloses another cooking process sensor that makes it possible, for example, to determine physical property values for cooking product evaluation. However, the introduction of a cooking process sensor into the cooking product is cumbersome, is a source for erroneous operation and leads to an unsightly insertion spot in the cooking product.

As an alternative to such cooking process sensors, contactless sensors are also known. An efficient gas sensor in the form of a gas sensor array is known, for example, from DE 44 23 289 C1. The gas sensor disclosed there is able to distinguish different complex odors from one another with the aid of an extensive signal pattern using a number of sensor areas. Thus, in principle, such a gas sensor array is able to track complex chemical processes, such as, for example, those that occur during the cooking of foods, based on the chemical composition of the atmosphere surrounding the cooking product. A food preparation appliance with such a gas sensor system, as well as a generic method for conducting a treatment program based on these measured values is known from DE 10 2004 062 737 A1. In the method disclosed in DE 10 2004 062 737 A1 during cooking the cooking chamber atmosphere is analyzed with a sensor and the treatment program is conducted within a predetermined bandwidth of previously stored target values. A disadvantage of this state of the art is that the user must first make a selection by an input into the food preparation appliance in order to start the correct treatment program.

A food preparation appliance for completely automatic cooking using a cooking process sensor to be introduced into the cooking product as well as performance of a cluster analysis is known from EP 1 666 798 A1.

General Description

Therefore, the task of the invention is to develop the generic method further in such a way that the disadvantages of the state of the art are overcome. Especially, the selection of a suitable treatment program should be simplified by the fact that the food preparation appliance automatically makes a suitable pre-selection of the cooking program and of the cooking parameters. Simultaneously, the entire ease of operation should be improved and the running of the treatment programs should be made more reliable and reproducible. An improvement of the quality of the result is naturally also desirable, with simultaneous avoidance of the insertion of a cooking process sensor into the cooking product.

This task is solved by the following process steps:

- Determination of at least one first value of the preparation chamber atmosphere and/or of the atmosphere surrounding the food preparation appliance before selection and/or beginning of the treatment program,
- Storing of the first value,
- Determination of at least one second value of the preparation chamber atmosphere and/or of the atmosphere surrounding the food preparation appliance after loading of the cooking product into the preparation chamber or after introduction of a lime removal and/or cleaning agent into the preparation chamber and/or after the beginning of the treatment program,
- Determination of at least one third value from the first and second value,
- Comparison of the third value with the stored values and
- Conducting the treatment program as a function of the result of the comparison of the third value with the stored values.

Hereby it can be provided that a cooking program, lime removal program or cleaning program is selected as the treatment program.

Especially preferred is hereby that in the case of selecting a cooking program the first value is determined before loading the preparation chamber with cooking product.

According to the invention, it can also be provided that with the first value the initial state of the food preparation appliance, especially of the preparation chamber and/or of the surrounding atmosphere is represented, whereby the initial state is determined by the contamination and/or history of the operation of the food preparation appliance and/or of the installation location.

In especially suitable methods, in the case of the selection of a cooking program, the second value is determined after loading the preparation chamber with cooking product and before or at the beginning of the treatment program.

Hereby, according to the invention it can be provided that the second and/or third value represents the loading of the preparation chamber with cooking product, especially determined by the nature, size, amount, seasoning, origin and/or state, especially the storage state of the cooking product.

In a process according to the invention it can be provided that the third value is obtained by subtraction of the second value from the first value, especially using a linear vector calculation.

Furthermore, it can be provided hereby that the first, second and/or third value is displayed, printed or stored, whereby preferably during storage at least one further information including a time indication, such as the time of day and/or date, and/or a location indication such as region, the country and/or the geodetic height at the installation location, is stored.

According to the invention it is additionally proposed that the third value and/or the treatment program, after it is conducted, is stored as a function of the third value, automatically or manually, whereby preferably the third value becomes a stored value.

Hereby it can be provided that the stored values are assigned to treatment programs, so that in the selection of a treatment program, only the stored values which are assigned to the selected treatment programs are used in the comparison with the third value.

Furthermore, it is an advantage here that when the first value is below at least one first minimum value and/or when the second value is below at least one second minimum value and/or the third value is below at least one third minimum value and/or when the first value exceeds at least one first maximum value and/or when the second value exceeds at least one second maximum value and/or when the third value exceeds a third maximum value an error message is given, an alarm is triggered, a processing instruction is issued for an operator and/or the treatment program is interrupted.

In this connection, it is proposed advantageously that the first value is set to zero either by the input of a command by an operator or automatically after the performance of a lime removal program, of a cleaning program, an aeration and/or a change of date.

Hereby it can be provided that after the comparison of the third value with the stored values, a treatment program is selected and is initiated or proposed, automatically, whereby preferably a proposed treatment program, especially at least one parameter thereof, can be altered or confirmed, at least within predetermined limits.

Furthermore, the methods according to the invention can be characterized by the fact that the first and/or second value is determined or modified after the introduction of water into the preparation chamber, especially that introduction arising from a treatment program.

Additionally, it is proposed according to the invention that an introduction of surrounding atmosphere into the preparation chamber, especially the volume flow of the surrounding atmosphere streaming into the preparation chamber, is taken into consideration in the determination of the first, second and/or third value, preferably by weighting.

Hereby it can be provided that a flushing of the preparation chamber with surrounding atmosphere, such as during cooling, moistening, moisture removal, humidifying or steaming, especially the duration of flushing and/or flush rate and/or an opening of the door of the preparation chamber, especially the degree of opening and/or the duration of opening is/are taken into consideration.

Furthermore, it can be provided that a flushing and/or an opening of the door is prevented during the determination of the first and/or second value.

Methods according to the invention can be also characterized by the fact that the time development of the first and/or second value is taken into consideration, preferably by differentiation and/or integration.

Hereby, it can be provided that a multiple number of first values are determined, especially distributed over the preparation chamber and/or the surroundings of the preparation chamber and/or as function of time and/or temperature, and/or a multiple number of second values is determined, especially distributed over the preparation chamber and/or the surroundings of the preparation chamber and/or as a function of time and/or temperature.

In this connection, it is proposed that at least one gas sensor array is used as sensor unit, and/or the first and second values are determined from the aroma in the preparation chamber and/or in the surroundings outside the preparation chamber, whereby preferably also at least one temperature sensor and/or one humidity sensor is used.

Hereby, it is advantageous when at least two first values and at least two second values are determined, of which one is representative for the preparation chamber atmosphere and the other one is representative for the surrounding atmosphere, whereby preferably a third first value is calculated, especially by subtraction, from which two first values and/or a third second value is calculated, especially by subtraction from the two second values.

Finally, it is proposed with the invention that a first third value is determined from the first first value and the first second value, a second third value is determined from the second first value and the second second value and/or a third third value is determined from the third first value and the third second value.

Thus, the invention is based on the surprising finding that, for example, by the introduction of a cooking product into the preparation chamber of a food preparation appliance, the composition of the preparation chamber atmosphere is changed so that with a suitable gas sensor for the determination of the preparation chamber atmosphere details, such as, for example, the type of cooking product, the pre-treatment, the quality and the seasoning of the cooking product can already be recognized, and this information can be used for the selection of a cooking program as well as for the conducting of it. In order to detect this change, the composition of the gases in the preparation chamber of the food preparation appliance must be determined before and after the preparation chamber is loaded with a cooking product, so that background aromas that are independent of the cooking product properties can be eliminated or at least reduced, for example by determining a difference. The initial state of the food preparation appliance is thus determined by a sort of calibration of the gas sensor, is stored and can be subtracted or taken into consideration during a subsequent cooking process. If the food preparation appliance is used continuously, the calibration can be done repeatedly automatically. A further reduction of the influences of background aromas can be achieved by detecting the surrounding atmosphere, that is, a measurement is performed, the results of which permits one to draw conclusions regarding the composition of the gases outside the preparation chamber but in the immediate surroundings of the cooking appliance. In the determination of the present state of the preparation chamber atmosphere one can also take into consideration the influence of the surrounding atmosphere, for example, the air in the kitchen. Thus one can ensure that the gas sensor provides good results without an intermediate cleaning or aeration of the preparation chamber having to be performed.

According to the invention, by comparison of different output signals of the gas sensor before and after the loading of the preparation chamber with a cooking product, it is possible to recognize the type of cooking product (for example, chicken), rapidly, and to propose to the user a cooking program (for example, grilled chicken) at an early stage.

If in a method according to the invention a gas sensor system is used, as is, for example, proposed in DE 10 2004 062 737 A1, it even becomes possible, for example, to recognize fish not only as fish, but also more specifically to distinguish between different types of fish, for example, perch, plaice or salmon. Thus, with the treatment program, various cooking parameters can be proposed to the user, for example the preparation chamber temperature, the final core temperature or the final cooking degree and the type of operation. Then the user can confirm the proposed parameters or alter the proposed parameters according to his/her wish. Using the method according to the invention, the food preparation appliance can store manually or automatically the desired parameters newly set by the user together with the cooking product recognized by the gas sensor system and then can correspondingly take into consideration this information in later applications of the treatment program.

The user may assign to the output signals or difference signals, which are determined by the cooking product, the pretreatment, the quality and the seasoning of the cooking product, certain characteristic names, for example "pork neck provençal" or Finkenwerd plaice. When this signal pattern is later encountered, these designations can be displayed to the user. Additional ease of operation is achieved through this learning process.

When the user enters obviously erroneous data, for example a setting of a preparation chamber temperature that is too low, which makes the desired cooking of a recognized food impossible, a correction can be made by the food preparation appliance. Then simple cooking parameters that were used during the last applications or that were already stored in the factory as typical cooking parameters can simply be set by the method. Naturally, the user will be informed about the possibly erroneous inputs.

With a reset function, the output signal of the gas sensor system can be reset again manually and automatically in order to make possible erroneous operation thereof recognizable. This reset function may be appropriate after cleaning or lime removal from the food preparation appliance or also after a change of date.

The detection of the surrounding atmosphere provides the additional advantage that when there is gas exchange between the preparation chamber atmosphere and the surrounding atmosphere, as occurs, for example, during cooling and moisture removal from the preparation chamber, the additional aromas introduced into the preparation chamber are already identified. If these odors are recognized by measurement of the surrounding atmosphere, the signals caused by the external aromas contained in the surrounding atmosphere can be distinguished from the signals produced by the cooking product.

Upon introduction of surrounding atmosphere into the preparation chamber, the volume flow, that is, the amount of surrounding atmosphere that flows into the preparation chamber per unit time, can be taken into consideration during the measurement. Conversely, in the case of a specific known aroma signal of the surrounding atmosphere, which does not occur in the preparation chamber, the volume flow in the preparation chamber can be determined from the change of the aroma signal.

The initial state of the cooking appliance can be determined quite definitively by the aromas in the surrounding atmosphere. An almost complete exchange of the preparation chamber atmosphere occurs when the preparation chamber door is open during the loading and unloading of the preparation chamber. The aromas in the surrounding atmosphere can even be so strong that the aromas in the preparation chamber at the beginning of the treatment program are determined so strongly by the surrounding atmosphere that measurement of the preparation chamber atmosphere becomes unnecessary at the beginning of the treatment program.

Hereby it can be of advantage when, as proposed in DE 10 2004 062 737 A1, a second gas sensor is used or, in case there is only one gas sensor, a sampling system is used for the measurement of the preparation chamber atmosphere and the surrounding atmosphere. Thus, the dead time that otherwise would occur during which the gas sensor system does not provide any measured values during the opening of the preparation chamber door, that is, during a gas exchange, to avoid undesired measurement results, can be avoided. The change of the gas composition when the door is open may nevertheless contain interesting information, too, for example, about the degree of opening of the preparation chamber door, so that measurement can be completely appropriate even when the door is open.

In addition, the air in the surroundings can provide information about combustion outside the preparation chamber. For example, when the scorching of a cable is detected with the aid of a signal of sufficient strength of a corresponding known perturbing aroma, the cooking appliance may display a corresponding warning message or a warning sound.

During, steaming, humidifying or moistening of the preparation chamber, water-soluble aromas may be introduced into the preparation chamber. It is also possible that aroma substances are dissolved from the surface of the cooking product by the water condensed or deposited on the food. This can, overall, lead to a change of aromas in the preparation chamber, in addition to the fact that the moisture in the air naturally has a large direct influence on the measurement of the preparation chamber atmosphere. If a humidifying device or a steam generator is operated, then this can be taken into consideration during the measurement. In the case of known states of the preparation chamber, for example in the unloaded state, the influence of the introduction of the water with the method according to the invention can be determined even in a targeted manner, in order to take this into consideration during the subsequent progress of treatment programs of the cooking appliance, in which such an introduction of water occurs.

In addition, also the time development of the signals of the gas sensor regarding the initial state can be taken into consideration. If fat remains on the walls of the preparation chamber after a treatment program, then this will produce aromas, for example by combustion during the subsequent heating of the preparation chamber. These aromas could also have developed during the previously run treatment program and so provide valuable information about the state of the preparation chamber. These signals and the signal development can therefore also be taken into consideration in the determination of the initial state.

Thus, the method according to the invention offers a whole series of advantages in comparison to the state of the art. The product quality of the cooked cooking product is increased, the expenditure during the operation of the appliances is reduced, the user needs less technical knowledge to use the food preparation appliance, the expenditure for monitoring during the running of treatment programs is reduced and the reproducibility and thus the reliability of the products produced by the food preparation appliance is increased.

Other characteristics and advantages of the invention follow from the subsequent description, in which practical examples of a method according to the invention are explained in detail using the schematic drawing consisting of a single figure.

BRIEF DESCRIPTION OF THE DRAWING

The FIGURE shows a schematic sectional representation of a food preparation appliance according to the invention.

DETAILED DESCRIPTION OF THE DRAWING

The food preparation appliance 1 comprises a preparation chamber 4, to which a gas sensor 8 is connected through a sampling system 12. Through the sampling system 12 gases from the preparation chamber 4 can be introduced to the gas sensor 8. The signals from the gas sensor 8 are evaluated by a central computer unit 16 of the food preparation appliance 1. The user has the possibility of setting up a treatment program according to his/her desires via an input unit 20. The input unit 20 is thereby connected to the central computer unit 16, which again is connected to a display element 24, on which the input of the user and other messages of the food preparation appliance 1 can be represented graphically and alphanumerically. The input unit 20 and the display element 24 can hereby also be designed as one unit. In addition to the gas sensor 8, a temperature sensor 25 and a humidity sensor 26 are also located in the preparation chamber 4, with which the climate parameters, temperature and moisture in the preparation chamber 4 can be determined. The output signals of the temperature sensor 25 and the humidity sensor 26 are used for controlling the preparation chamber climate, which occurs specifically by controlling a steam generator 28, heating elements 29, an air circulation fan 40 and/or an aeration device 44. The signals of the climate sensors 25, 26 are also taken into consideration in the evaluation of the gas sensor 8, in order to obtain a total picture of the situation for cooking product 31 in the preparation chamber 4.

Even before the selection of a treatment program by the user through the input unit 20, the central computer unit 16 analyzes the atmosphere in the preparation chamber 4 with the aid of gas sensor 8, that is, the initial situation in which gases from the preparation chamber 4 are introduced to the gas sensor 8 via the sampling system 12. When the food preparation appliance 1 remains turned on, this can be performed at regular intervals or continuously, or can be initiated by the opening and closing of a door (not shown) of the preparation chamber 4 with the aid of a door contact switch 27.

When the cooking product 31 is introduced into the preparation chamber 4, by pushing it on a cooking product carrier 32 into a hanging rack (not shown), a measurement of the composition of the preparation chamber atmosphere is again performed via the gas sensor 8, initiated, for example, by a cooking product carrier contact switch (not shown). By forming a difference between the sensor signals before loading of the preparation chamber 4 and after loading of the preparation chamber 4 with the cooking product 31, a difference in the gas composition of the preparation chamber atmosphere caused by the cooking product 31 can be determined independently of perturbing background aromas.

Typical signal patterns for different foods, seasoning compositions, marinades or similar are stored in the memory 36 of the central computer unit 16. Not only is the said calculation of differences performed in the central computer unit 16, but the calculated difference is also compared with known signal patterns. When a difference signal pattern is recognized, a treatment program will be proposed to the user via the display element 24, which corresponds to the recognized cooking product 31 with the recognized marinade or seasoning composition.

Then the user is able to confirm or change the preset parameters and the preset treatment program using the input unit 20. Newly set client inputs are stored by the central computer unit 16 together with the difference signal pattern in memory 36 in order to propose to the user, upon future recognition of the same or similar difference signal pattern, these last set parameters and/or the last set treatment program using display element 24. Similarly, when an unknown difference signal pattern occurs, then a client wish is input by the user through input unit 20, the so-far unknown difference signal pattern is stored in memory 36 of the central computer unit 16, namely with the client desire for parameters and/or a treatment program.

The stored data can be statistically analyzed in the computer unit 16. Thus, for example, in case of a given difference signal pattern, it is possible to propose to the user the cooking parameters or treatment programs that are most frequently set for this difference signal pattern.

Data, together with other parameters, for example the time and date, are stored regularly in memory 36, for example, every 10 seconds. If at a given time (for example at breakfast or similar) or on given dates (for example, Sunday, Christmas or similar) a certain cooking product 31, which is recognized by the seasoning and by the type of cooking product, is prepared with a certain treatment program, then when the same or a very similar difference signal pattern occurs at this exact time or on this date, a corresponding treatment program and corresponding cooking parameters can be preset and proposed to the user. This date and time information is thus taken into consideration in the selection of the treatment program corresponding to the difference signal pattern stored in memory 36 by computer unit 16.

If the cooking product is meat, then, as well as the seasoning and marinade of the cooking product 31, its fat content near its surface also plays a role in the browning of the piece of meat. When the amounts of fat are large, browning reactions occur more rapidly all the way to undesirable blackening. Since information on the fat content can also be determined with gas sensor 8, it is possible to adjust the treatment programs or the parameters of the treatment programs, correspondingly. Thus, a lesser browning will be achieved by reducing the treatment temperature via the heating elements 29 and the preparation chamber circulation via the speed of the air circulation fan 40.

In addition to the fat content, it is also advantageous to take into consideration the water content, the size of the piece, the total amount of charge, the kind of meat (for example beef, pork, lamb, etc.), the cut of meat (for example, shoulder, neck, back, breast, leg, etc.) and also the origin or the type of feeding in the preparation of the meat. This is made possible by evaluation of the output signals of the gas sensor 8, of the humidity sensor 26 and the temperature sensor 25. For this purpose the time development of the signals at a given heating rate is considered. Correspondingly, the time derivatives of the signals can be considered. More accurately stated, consideration of all sensor data from sensors 8, 25, 26 of the food preparation appliance 1 and their time development can be used to obtain a complete picture of the cooking product 31 that can be used for controlling the treatment program; for example, the output data of the three sensors 8, 25, 26 can be evaluated as follows:

A slow increase of the preparation chamber temperature with a high heat input indicates a large total amount of charge. If at the same time a strong signal of the gas sensor 8 occurs, this is a further indication of a large amount of charge.

When, during increasing cooking degree of the cooking product 31, as it is detected by the gas sensor 8, the humidity increases rapidly, then this is an indication of a high water content in the cooking product 31. Hereby the already-determined the total amount of charge must be taken into consideration. At the same time, as a result of water leaving the cooking product 31, early exudation of aroma substances from inside the cooking product 31 is promoted, which again can be recognized by more rapid increase of the corresponding signal pattern of the gas sensor 8 as a function of time.

Large pieces can be recognized by a slower development of the cooking degree, that is, by a smaller increase of the output signals of the gas sensor 8.

The method of the invention hereby permits, for example, the conducting of a cooking program after loading of the preparation chamber 4 with cooking product 31, as follows:

The recognition of the type of cooking product 31 occurs in a stepwise manner, that is, for example, first it is recognized that the cooking product 31 is meat and not vegetable. Already, based on this, the first settings of the preparation chamber climate can be performed. Then, for example, it is recognized that a seasoning is present on but no marinade is present in the cooking product 31, which influences the setting of the preparation chamber temperature. Then the difference signal pattern develops further, for example so that only beef comes into consideration as cooking product 31. Here a display on the display element 24 may occur, which informs the user that a treatment program for seasoned beef was started. At the same time, the user is given the possibility of changing the predetermined settings via the input unit 20, which are then stored again by the computer unit 16 together with the difference signal pattern and the time development of the difference signal pattern.

With the input, the user indicates, for example, a certain desired browning and a certain consistency. During the cooking process the central computer unit 16, based on the output signals of the gas sensor 8, recognizes that the beef has a high fat content on the surface and was only briefly hung for maturation. Then the treatment program is adjusted in such a way that the desire of the client regarding the browning of the food can be achieved. This can be achieved by reducing the preparation chamber temperature, since the high fat content leads to a more rapid browning. In order, for example, to achieve a tender consistency of the beef in spite of the brief maturation phase during aging, a maturation phase can be set with an increased degree of cooking. That is, the maturation of the meat is made up by keeping the temperature at which the cooking product 31 is held at a lower preparation chamber temperature, that is, at a final core temperature that remains as constant as possible for a given time. In this way, a post-maturation of the meat is achieved. This is communicated to the user via the display element 24 so that the user is able to remove the already-cooked but not completely matured meat from the preparation chamber and to free the food preparation appliance 1 for another application.

Further optimization of cooking programs is possible with the aid of the method according to the invention. Thus, for example, the course of the preparation chamber temperature can be adjusted to a desired degree of browning corresponding to the seasoning or marinade of a food that was recognized by the evaluation of the sensor signals. For example, a marinade with sugar when using the same treatment program leads to a stronger browning of a cooking product in comparison to an untreated food or a food that was marinated with a sugar-free marinade. When the same degree of browning is desired, that is determined either by the client input in the food preparation appliance or can be preset by a basic setting, it is possible to reduce the preparation chamber temperature of a treatment program when a sugar-containing marinade was recognized. In this way the desired browning successfully leads to a consistent end result independently of the marinade.

When the gas sensor 8 consists of a number of sensor areas, for example, as known from DE 44 23 289 C1, the signals can be represented as vectors. For example, when the gas sensor 8 consists of twenty individual areas, then the sensor signal is first displayed as a vector consisting of twenty linearly independent unit vectors. Additionally, other information can be included regarding the climate in the preparation chamber 4, for example the temperature and the humidity as addition linearly independent information, so that a twenty-two-tuple, that is, a vector consisting of twenty-two linearly independent unit vectors, is produced, and this is used for the calculation of the status, and especially for recognizing the time development of the preparation chamber climate.

By training the sensor system 8, 25, 26, for example, a three-dimensional subspace of the twenty-two dimensional vector space can be created by projection. The position of the three-dimensional subspace is hereby chosen so that the expected changes of the sensor signals are shown especially strongly with the aid of the vectors reduced to three dimensions. With this method, the influence of disturbing aromas on the sensor signals can be reduced by eliminating the dimensions of the vector signals caused by the disturbing aromas, by the use of the projection. All this happens by the training of the sensor system 8, 25, 26. The three-dimensional projection plane is thereby rotated during the course of a treatment program as frequently as necessary within the twenty-two-dimensional space. It is also conceivable for the dimension of the subspace to be adjusted to the result to be recognized, that is, for example, a two-dimensional or four-dimensional subspace is considered. With the method according to the invention, evaluation of the sensors 8, 25, 26 can now be made insensitive even to such disturbing aromas that are unknown and have signal portions in the considered projection plane, as they occur, for example, in several directly successive cooking processes with the same cooking product. Alternatively, a back-transformation into a linearized space can be performed for the evaluation of the sensor signals.

In case of an unknown deviation from typical odor profiles deposited in the memory 36, one can deduce the presence of undesirable substances. Thus, disturbing aromas may be due to residues of cleaners or rinses, packaging materials, cooking tools or even poisons, and trigger the message on display device 24 of "unknown substances in the preparation chamber," and optionally the user also receives an acoustic warning. If the aroma profile of a disturbance is known, the treatment program can be completely stopped or, after a confirmation, a query or an intervention by the user, can be continued. This can, for example, be useful for the recognition of gun pellets in cooking product 31, specifically in venison, or combustion residues on the heating elements 29 of the food preparation appliance 1.

The detection of leaks in the preparation chamber 4 or in a combustion chamber (not shown) of a food preparation appliance 1, operated with gas, is also a possible disturbance, whereby, for example, a suggestion for performing maintenance on the display element 24 can then be provided. In case of a larger gas leak, the food preparation appliance 1 is shut down with simultaneous aeration of the preparation chamber 4 using an aeration device 44 in order to prevent fires. Every disturbance is recorded in a safety protocol (HACCP protocols) of the central computer unit 16, so that later checking by third parties is possible.

In addition to the course of cooking programs, the course of a cleaning program in the food preparation appliance 1 can be monitored with the gas sensor 8 and the other sensors 25, 26 of the food preparation appliance 1 and controlled and regulated by the central computer unit 16. For example, here it can be recognized how extensive the contamination is or if an incorrect amount of cleaner or rinse was used. Then the user can obtain suitable information via the display element 24 in order to react to it. If there is no reaction by the user, the adjustment of the cleaning program can be done automatically by the central computer unit 16, for example by adjustment to incorrect conditions.

The cleaning effect of a cleaning program can also be monitored with the gas sensor 8. Thus, residues remaining in the preparation chamber 4 can be recognized with the gas sensor 8 and the cleaning program can be adjusted correspondingly in order to make the desired complete cleaning of the preparation chamber possible. It is also possible to provide information about the remaining of residues to the user, who then can initiate suitable steps via the input unit 20.

By storing all processes in memory 36 of the central computer unit 16, possible complaints can be checked by the user, and, simultaneously, improved error analysis of the food preparation application 1 can be performed.

The characteristics of the invention disclosed in the above description, in the drawing as well as in the claims can be essential both individually as well as in any arbitrary combination for the realization of the invention in its various embodiments.

REFERENCE NUMBER LIST

| | |
|---|---|
| 1 | Food preparation appliance |
| 4 | Preparation chamber |
| 8 | Gas sensor |
| 12 | Sampling system |
| 16 | Computer unit |
| 20 | Input unit |
| 24 | Display element |
| 25 | Temperature sensor |
| 26 | Humidity sensor |
| 27 | Door contact switch |
| 28 | Steam generator |
| 29 | Heating element |
| 31 | Cooking product |
| 32 | Cooking product carrier |
| 36 | Memory |
| 40 | Air circulation fan |
| 44 | Aeration device |

We claim:

1. Method for conducting a treatment program in a preparation chamber of a food preparation appliance, in which at least the preparation chamber atmosphere of the food preparation appliance is detected by at least one sensor unit, and the treatment program is conducted as a function of values detected with the at least one sensor unit and of values stored in a memory unit, the method comprising:

determining at least one first value of the preparation chamber atmosphere and/or the atmosphere surrounding the food preparation appliance with the at least one sensor unit before selecting and/or beginning a treatment program;

storing the first value;

determining at least one second value of the preparation chamber atmosphere and/or of the atmosphere surrounding the food preparation appliance with the at least one sensor unit after loading a cooking product into the preparation chamber or after introducing a lime removal and/or cleaning agent into the preparation chamber and/or after beginning the treatment program;

wherein the at least one sensor unit comprises a gas sensor array with which the first and second values are determined from an aroma in the preparation chamber and/or in the surroundings outside the preparation chamber;

determining at least one third value from the first value and the second value;

comparing the third value with stored values; and conducting a treatment program as a function of the result of comparing the third value with the stored values.

2. Method according to claim 1, further comprising selecting a treatment program from the group consisting of a cooking program, a lime removal program, and a cleaning program.

3. Method according to claim 2, wherein determining at least one first value occurs before loading the preparation chamber with a cooking product when the treatment program comprises a cooking program.

4. Method according to claim 2, wherein the first value represents an initial state of the food preparation appliance, whereby the initial state is determined by at least one of a contamination of the food preparation appliance, a history of the operation of the food preparation appliance, and an installation location of the food preparation appliance.

5. Method according to claim 4, wherein the initial state of the food preparation appliance comprises the initial state of at least one of the preparation chamber and the surrounding atmosphere.

6. Method according to claim 2, wherein determining the at least one second value occurs after loading of the preparation chamber with cooking product and before or at the beginning of the treatment program when the treatment program comprises a cooking program.

7. Method according to claim 1, wherein at least one of the second value and the third value represents the loading of the preparation chamber with cooking product.

8. Method according to claim 7, wherein at least one of the second value and the third value represents at least one of a nature, a size, an amount, a seasoning, an origin, and a state of the cooking product.

9. Method according to claim 8, wherein the state of the cooking product comprises a storage state of the cooking product.

10. Method according to claim 1, wherein determining at least one third value comprises subtracting the second value from the first value.

11. Method according to claim 10, wherein determining at least one third value comprises using a linear vector calculation.

12. Method according to claim 1, further comprising at least one of displaying, printing, and storing at least one of the first value, the second value, and the third value.

13. Method according to claim 12, further comprising storing at least one further information including at least one of a time indication and a location indication.

14. Method according to claim 13, wherein the time indication comprises at least one of a time of day and a date.

15. Method according to claim 13, wherein the location indication comprises at least one of a region, a country, and a geodetic height at an installation location.

16. Method according to claim 1, further comprising storing at least one of the third value and the treatment program as a function of the third value, after the treatment program is conducted.

17. Method according to claim 16, wherein storing the at least one of the third value and the treatment program as a function of the third value is done either automatically or manually.

18. Method according to claim 17, wherein the third value comprises a stored value.

19. Method according to claim 1, further comprising assigning the stored values to treatment programs such that, in the selection of a treatment program, only the stored values that are assigned to the selected treatment programs are used while comparing the third value with the stored values.

20. Method according to claim 1, further comprising:

giving an error message, triggering an alarm, issuing a processing instruction for an operator, and/or interrupting the treatment program when:

the first value is below at least one first minimum value, the second value is below at least one second minimum value, and/or the third value is below at least one third minimum value; or the first value exceeds at least one first maximum value, the second value exceeds at least one second maximum value, and/or the third value exceeds at least one third maximum value.

21. Method according to claim 1, further comprising setting the first value to zero after the performance of at least one of a lime removal program, a cleaning program, an aeration, and a change of date.

22. Method according to claim 21, wherein setting the first value to zero comprises one of automatically setting the first value to zero or setting the first value to zero by an input of a command from an operator.

23. Method according to claim 2, wherein selecting a treatment program further comprises:

automatically selecting a treatment program after comparing the third value with the stored values, and initiating or proposing the selected treatment program.

24. Method according to claim 23, wherein the proposed treatment program can be altered or confirmed at least within predetermined limits.

25. Method according to claim 24, wherein at least one parameter of the proposed treatment program can be altered or confirmed at least within predetermined limits.

26. Method according to claim 21, further comprising determining or modifying at least one of the first value and the second value after introducing water into the preparation chamber.

27. Method according to claim 26, wherein introducing water into the preparation chamber arises from a treatment program.

28. Method according to claim 1, further comprising introducing surrounding atmosphere into the preparation chamber, and wherein determining at least one of the first value, the second value, and the third value comprises considering the introduction of the surrounding atmosphere.

29. Method according to claim 28, wherein considering the introduction of the surrounding atmosphere includes considering the volume flow of the surrounding atmosphere being introduced into the preparation chamber.

30. Method according to claim 28, wherein determining at least one of the first value, the second value, and the third value comprises weighting the respective value based on the surrounding atmosphere being introduced.

31. Method according to claim 28, further comprising considering a flushing of the preparation chamber with surrounding atmosphere.

32. Method according to claim 31, wherein considering a flushing of the introduction of the surrounding atmosphere comprises considering at least one of a duration of introduction, a flush rate, and an opening of the door of the preparation chamber.

33. Method according to claim 32, wherein considering an opening of the door comprises considering at least one of a degree of opening of the door and a duration of opening the door.

34. Method according to claim 32, wherein the flushing of the surrounding atmosphere into the preparation chamber occurs during one of cooling, moistening, moisture removal, humidifying, and steaming.

35. Method according to claim 1, further comprising preventing at least one of introducing the surrounding atmosphere into the preparation chamber and opening the door while determining at least one of the first value and the second value.

36. Method according to claim 1, further comprising considering the time development of at least one of the first value and the second value.

37. Method according to claim 36, wherein considering the time development of at least one of the first value and the second value comprises performing at least one of a differentiation and an integration.

38. Method according to claim 1, further comprising determining at least one of a multiple number of first values and a multiple number of second values.

39. Method according to claim 38, wherein the multiple number of first values are distributed over at least one of the preparation chamber, the surroundings of the preparation chamber, as a function of time, and/or as a function of temperature.

40. Method according to claim 38, wherein the multiple number of second values are distributed over at least one of the preparation chamber, the surroundings of the preparation chamber, as a function of time, and/or as a function of temperature.

41. Method according to claim 1, wherein determining the first value and determining the second value comprises using providing the at least one gas sensor array as the sensor unit.

42. Method according to claim 1, further comprising:

determining at least two first values and at least two second values, of which one of the first values and one of the second values is representative for the preparation chamber atmosphere and the other is representative for the surrounding atmosphere.

43. Method according to claim 42, further comprising at least one of:

calculating a third first value from the two first values; and calculating a third second value from the two second values.

44. Method according to claim 43, wherein calculating the third first value and the third second value comprises performing a subtraction.

45. Method according to claim 42, further comprising determining at least one of:

a first third value from the first value and the first second value, a second third value from the second first value and the second value, and a third third value from the third first value and the third second value.

* * * * *

UNITED STATES PATENT AND TRADEMARK OFFICE

CERTIFICATE OF CORRECTION

PATENT NO. : 8,178,142 B2
APPLICATION NO. : 12/027727
DATED : May 15, 2012
INVENTOR(S) : Greiner et al.

It is certified that error appears in the above-identified patent and that said Letters Patent is hereby corrected as shown below:

In the Claims

In Column 13, Line 39, in Claim 26, delete "claim 21," and insert -- claim 1, --, therefor.

In Column 14, Line 38, in Claim 41, delete "comprises using" and insert -- comprises --, therefor.

Signed and Sealed this
Ninth Day of September, 2014

Michelle K. Lee

Michelle K. Lee
*Deputy Director of the United States Patent and Trademark Office*